US006120316A

United States Patent [19]

Allgaier et al.

[11] Patent Number: 6,120,316

[45] Date of Patent: Sep. 19, 2000

[54] CABLE PLUG CONNECTOR

[75] Inventors: Bernhard Allgaier, Wendlingen; Bernd Hagmann, Geislingen, both of Germany

[73] Assignee: Richard Hirschmann GmbH & Co., Neckartenzlingen, Germany

[21] Appl. No.: 09/171,124

[22] PCT Filed: Mar. 14, 1997

[86] PCT No.: PCT/EP97/01295

§ 371 Date: Oct. 13, 1998

§ 102(e) Date: Oct. 13, 1998

[87] PCT Pub. No.: WO97/39495

PCT Pub. Date: Oct. 23, 1997

[30] Foreign Application Priority Data

Apr. 13, 1996 [DE] Germany ..... 196 14 699
Mar. 4, 1997 [DE] Germany ..... 197 08 663

[51] Int. Cl.[7] ..... H01R 4/24

[52] U.S. Cl. ..... 439/404; 439/402

[58] Field of Search ..... 439/395, 402, 439/404, 390, 391, 392, 393, 394, 396, 397, 398, 399, 400, 401, 403, 405, 421, 406, 407, 417, 418, 422

[56] References Cited

U.S. PATENT DOCUMENTS

| | | | |
|---|---|---|---|
| 4,648,676 | 3/1987 | Carrell | 339/97 |
| 5,000,698 | 3/1991 | Kuzuno et al. | 439/395 |
| 5,112,244 | 5/1992 | Kuzuno et al. | 439/395 |
| 5,129,840 | 7/1992 | Kuzuno et al. | 439/397 |
| 5,399,097 | 3/1995 | Sakai et al. | 439/305 |

FOREIGN PATENT DOCUMENTS

3032576 A1 4/1982 Germany .

4214711 6/1993 Germany .

*Primary Examiner*—Paula Bradley
*Assistant Examiner*—Alexander Gilman
*Attorney, Agent, or Firm*—Fulbright & Jaworski, L.L.P.

[57] ABSTRACT

A cable plug connector (1) with at least one contact (3) fitted in a chamber of a contact carrier (2) and taking the form of a plug (8) which has an insulation displacement section (9) at its connection end (11) to contact an insulated cable lead (5) inserted into a blind hole (24) in the contact carrier (2) by means of an insulation displacement slot (16) fitted in a contact plate (14) running transversely to the plug-in direction, the insulation displacement section (9) is a separate part passing with the contact plate (14) through an aperture (20) in the connection end (11) of the plug (8). The contacts (3) are thus simply and economically suitable for the use of different lead diameters by exchanging the insulation displacement section (9). They are also usable with advantage especially in cable plug connectors (1) produced by injection molding because no special measures are needed to seal the plug contact regions. The invention is particularly suitable for practical manipulation to fit the contact plate (14) with snapping projections (19) which engage behind the lateral end sections of the aperture (20). This renders the insulation displacement section (9) captive through pre-snapping, further simplifies storage and assembly and makes it even cheaper. This advantage and even simpler production and assembly can also be obtained in a particularly suitable manner in that the insulation displacement section (9) has two guide arms (31) which, with bent end sections (32), preferably engage behind a cover section (41) which has through apertures (42) and U-shaped guides (25) for the insertion or guiding of the cable leads (5), and can be secured to the contact carrier.

38 Claims, 6 Drawing Sheets

CABLE PLUG CONNECTOR

The invention relates to a cable connector, as is known for example from DE 42 14 711 C 1 in a multipin version. In this connector the contacts are produced as economical stampings, a process that accomplishes part bending, automatic core feed, and reliable contact without stray strands from stranded wires. On the other hand, the contacts are suited only for one-time mounting, since they are bent in the contact carrier and would be damaged when forcibly removed to break the core contact. In addition, only cable cores of a defined diameter which corresponds to the clamping slot width can be connected by this fixed design. A special cable connector is required for each cable size.

In addition, the contacts must be inserted radially over their entire length in the contact carrier which must have correspondingly large openings for this purpose; this poses major difficulties in injection-molded versions, or requires additional sealing measures.

Last but not least, as a result of their integral design the contacts cannot be optimally configured with respect to material choice and material cost, so that only a compromise between the most favorable properties of the insulation-piercing connecting device and plug-in contact can be achieved.

Among mass products such as connectors, the increased costs associated with the above-indicated properties can generally not be tolerated in a multipin design.

SUMMARY OF THE INVENTION

An object of the invention is to develop a cable connector in which the contacts can be used as easily and economically as possible for different core diameters and the cable connector can also be injection molded at low cost. In doing this the initially described advantages of the cable connector known from DE 42 14 711 C1 will be preserved.

This object is achieved by the characterizing features of the invention. The two-part structure, i.e. separation of the plug-in contact part and insulation piercing connecting device part, allows the two parts to be easily separated from one another. If necessary, the insulation piercing connecting device parts, which have variously wide insulation-piercing connecting device slots for making contact with cable cores of different core diameters, can be inserted through the recess in the terminal-side end of the plug-in contact part. When using the cable connector for cables with different core diameters, only the insulation-piercing connecting device parts are made as slides and not all the contacts need be replaced.

The plug-in contact part can be placed securely and tightly in the contact carrier, which makes the connector design of the invention especially well suited for extrusion coating because no coating material can reach the plug-in contact area of the contact carrier. For this reason, and in contrast to the prior art, no additional sealing measures need be taken. Therefore, the same contact carrier can be used to produce either a preassembled or extrusion coated cable connector, thus reducing warehouse requirements.

Advantageous embodiments of the invention are cited in the dependent claims.

By making a recess, good guidance of the contact plate can be achieved. It is further improved by a support surface which projects into the interior of the contact carrier at roughly 90 degrees from the lower edge of the recess. The contact plate to be actuated as a slide, without requiring special attention of the installer, thus meets the cable core with which contact is to be made at roughly a right angle, so that optimum contact-making is ensured because the cable core thus penetrates into the contact slot as far as the stipulated position.

The production costs of this support surface are especially low if it is formed by simple punching and pressing out from the terminal-side end part of the plug-in contact part.

The two clamp legs formed by the insulation piercing connecting device slot are also somewhat elastic transversely to the insulation piercing connecting device slot and therefore can be pressed together somewhat on the free ends. This property is used as follows.

When the contact plate is pressed in, the clamping legs are pressed together so far that they can be pushed with the catch projection forward through the recess of the terminal-side end part of the plug-in contact part. After passage through the recess the clamping legs spring to their set distance, causing the catch projections to fit behind the edge sections of the recess, the insulation-piercing connection device parts to be therefore caught beforehand and held captively in the contact. This is the delivery configuration, so that separate parts need not be kept available for installation at the destination.

For easier insertion of the contact plate the catch projections have conical inlet bevels.

To remove the contact plate from the recess, for example in the case of replacement by another insulation piercing connecting device part, the clamp leg ends are pushed together somewhat by means of a simple tool.

As the surface for applying a tool (for example, pliers) for insertion, but mainly for removing the contact plate though the recess of the terminal-side end part of the plug-in contact part, it is advantageous to provide a link-like extension which is stiffened by a raised part (or also by ribs or the like) in order to be able to reliably accomodate the forces exerted by the tool.

By one advantageous version the adjoining outside parts correspond to the desired contact set position of the contact plate in which the optimum terminal connection is achieved and shearing off of the cable cores on the upper edge of the blind hole is effectively prevented. At the same time, between the non-adjoining area of the extension and the terminal-side end part of the plug-in contact part, a tool can be inserted for removal of the contact plate.

The extension could also be completely omitted or can be made such that there is no tool engagement between it and the terminal-side end part of the plug-in contact part. For this case it is advantageous to provide tool engagement by a corresponding recess or opening in the contact plate section which projects to the outside over the terminal-side end part.

Another advantageous structure of the insulation-piercing connecting device consists in executing the extension according to the contact plate, and the width of the two contact slots can be of various size so that by simply turning the insulation-piercing connecting device part, two core diameters are covered.

By means of one especially advantageous configuration of the terminal-side end part of the plug-in contact part, the two clamping legs of the contact plate are held stably in their set position, which effectively prevents spreading when the cable cores are inserted. In this way not only is a uniformly high contact force of the insulation-piercing connecting device part ensured, but also unwanted sliding back of the contact plate and thus loosening of the contact is easily and reliably prevented. In addition, in this way the clamping legs can be made narrower without reducing the necessary contact force. This enables a smaller construction, which satisfies one of the basic requirements for connectors.

This approach also ensures a conductive connection between the plug-in contact and the insulation-piercing connecting device part that is permanently reliable, even when exposed to strong vibrations. The advantage of an integral design of the contacts in this respect is preserved in spite of the two-part design as claimed in the invention.

In one configuration of the cable connector, accurate guidance of both the cable cores and also the contact plate is easily achieved. Thus it is always ensured that contact of the insulation-piercing connecting device takes place in the optimum manner at the correct location of the cable cores and in the stipulated area of the insulation piercing connecting device slot.

It is especially advantageous to make this u-shaped insulating part in one piece with the contact carrier because in this way production is more economical and the part is stable in position.

In one alternative structure of the cable connector with a cover part which seals the terminal-side area of the contact carrier, the u-shaped insulating part can be made integral with this cover part. When the cover part is mounted it projects on the front side to almost the inserted contact plate into the contact chamber of the contact carrier. From the plug side the front of the edge part of the blind hole likewise almost reaches to the inserted contact plate so that a slot-like recess for insertion of the contact plate is formed between the two fronts.

Compared to the described version, in which the u-shaped insulation part is integral with the contact carrier, the insulation part itself need not have a slot. Together with its arrangement on the cover part, faster, more reliable and more economical production is enabled, especially due to the much simpler tools and production steps (for example, in the injection molding process).

Also in this structure, the insertion of the cable core is completely free of problems since it need be simply pushed through the penetration opening which is provided with an insertion funnel and which is preferably matched to the core cross section in the cover front plate and thus slides automatically through the u-shaped insulating part into the blind hole. Especially for multipin cable connectors, this enables prompt mounting because only the individual cores need be inserted into the insertion funnel of the penetration openings on the easily visible and accessible cover surface. Then the entire cable is pushed in. The cores are thus reliably inserted into the pertinent blind holes without the danger that the insertion process would be hindered by seating of wire on the edge part of the u-shaped insulating parts.

In multipin versions it is feasible to arrange the u-shaped parts in pairs offset by 180 degrees to one another because then, using a simple, pliers-like tool which engages two opposing extensions, two contact plates at a time can be inserted to make contact between the two cable cores.

When the configuration of the contacts is symmetrical, and an asymmetrical arrangement does not cause unambiguous joining of the cover part and contact carrier, one configuration of the u-shaped insulating parts represents one simple coding possibility. This is especially useful when the cable connector is extrusion coated and there is no housing for attachment of the coding elements.

The cover part and the contact carrier can be joined to one another either detachably or securely. The first version, which can be implemented for example by extrusion coating, cementing or plastic welding, is cost-effective and especially suited for tight cable connectors. The second version, which is produced for example by a screw, clip or catch connection, enables use of the same contact carrier with different cover parts which have insertion openings for cable cores of differing thicknesses.

In addition, this detachability enables easy replacement of the insulation-piercing connecting device parts (optionally also individually) by those which have contact plates with insulation-piercing connecting device slots of different dimensions. Thus, high adaptability to the most varied applications is achieved.

According to another advantageous version of the cable connector, the cover part has at least one recess which fits into a front-side projection of the contact carrier when the cable connector is being installed.

It is especially advantageous if, the contact chamber separators of the contact carrier fit into matched, grooved recesses of the cover part and gaps between the u-shaped insulating parts. In this way not only is installation simplified by exact positioning and fixing of the cover part on the contact carrier, but there is also an especially simple coding possibility without an additional part, using a symmetrical structure of the cable connector and identically made u-shaped parts.

A cable connector in which all contacts are arranged can be especially easily operated in an advantageous manner. Here it is a good idea to place all contacts in one plane so that the axial length of the cable connector is as small as possible.

By means of a symmetrical configuration, a minimum periphery or diameter of the cable connector can be achieved, contributing significantly to its miniaturization.

If in special cases (for example, in push-on plug distributors) several cable cores are to be connected to one contact it is advantageous to equip the contact plates with a corresponding number of insulation piercing connection device slots and to provide an equal number of blind holes. Thus the slot widths can be of the same or different sizes according to the diameters of the cable cores to be connected.

If the cable connector is not extrusion coated, it generally has a housing which closely encompasses the contact carrier, for example a housing made in the form of a handle sleeve. In this case a housing structure is especially favorable, since after attaching the handle sleeve additional security of the insulation-piercing connecting device part in the contact set position is achieved without the slightest additional cost and thus permanently secure contact of the cable cores is also ensured when the cable connector is exposed to strong vibration.

As a result of the low material thickness of the plug-in contact part made as a sheet metal punching, the contact plate to be inserted through its recess (especially without the support as claimed in claim 3) in the vertical direction is unstable and accurate insertion to make contact with the cable cores is difficult.

By means of an especially advantageous design of the insulation piercing connecting device part, its reliable guidance in the desired direction is easily ensured even when the force exerted on the insulation-piercing connecting device part to insert or remove it does not act in the desired direction or does so only in part, so that tilting is effectively prevented.

In doing so, guidance in the plane perpendicular to the plug axis is achieved by guide surfaces on which the terminal-side and the plug-side surface slide along the guide arm. The distance of the guide surfaces is for this reason slightly greater than the thickness of the material of the guide arms so that both easy sliding and also sufficient guidance of the guide arm are achieved in the indicated plane.

Production is especially simple when the guide surfaces for the terminal-side surfaces of the guide arms are mounted in the cover part, because this makes simple tools possible.

There is guidance of the insulation-piercing connection device part in the desired direction within the indicated plane in this way to a degree sufficient for many applications by the guide arms closely encompassing the u-shaped insulating parts on the side and the outside edges of the clamping legs sliding along on the inside surfaces of the side walls of the terminal-side end part. To further improve this guidance, according to one advantageous embodiment of the cable connector, the side edges of the guide arms run at a very short distance from the contact chamber separators.

The insulation-piercing connection device part is simple and economical to build and manufacture when it is made in one part, for example as a sheet metal punching.

One especially advantageous embodiment of the insulation-piercing connecting device part is an implementation of a captive arrangement of the insulation-piercing connecting device part which has the advantage that the clamping legs do not require catch projections extending to the outside. In this way the amount of lateral space required by the insulation-piercing connecting device part is minimized so that the contact chambers can be made weaker. In this way the dimensions of the cable connector are smaller transversely to the axis (for round connectors, the diameter) and thus meet a basic requirement in electrical connectors.

In addition, in this version the outside edges of the clamping legs over their entire length slide along the separators and thus improve guidance of the insulation-piercing connecting device part.

But mainly the clamping legs need not be made springy (transversely to the insulation-piercing connecting device slot) so that for the insulation-piercing connecting device part a much larger selection of materials is available. Rigid materials, especially, can be chosen which ensure defined core squeezing in the insulation-piercing connecting device slot.

The retaining shoulders can be made as parts of the contact carrier. This however would make its structure more complex and would allow rigid materials for the insulation-piercing connecting device slot only under certain conditions.

One advantageous embodiment of the cable connector consists of, as the retaining shoulders, the area of the walls already present on the cover part, for example, to form a groove-shaped recess for holding a contact chamber separator.

In one embodiment, the guide arms are roughly as long as the clamping legs of the contact plate. In this way a maximum separation length of the guide arms is achieved so that even when using thicker cable cores the contact plate can be pushed back so far that the cable cores can be withdrawn from the cable connector.

Breaking of core contact by pulling out the insulation-piercing connecting device part can be handled especially easily by inserting a simple tool between the extension of the insulation-piercing connecting device and the base wall of the terminal-side end part of the plug-in contact part. This is facilitated without additional cost by the extension being lengthened by a link bent somewhat to the outside.

BRIEF DESCRIPTION OF THE DRAWINGS

The invention is detailed below using a first embodiment of a cable connector shown in FIGS. 1 to 3 and a second shown in FIGS. 4 to 8 with four core terminals, the same parts being designated with the same number in both embodiments.

DETAILED DESCRIPTION OF THE INVENTION

Figure 1:
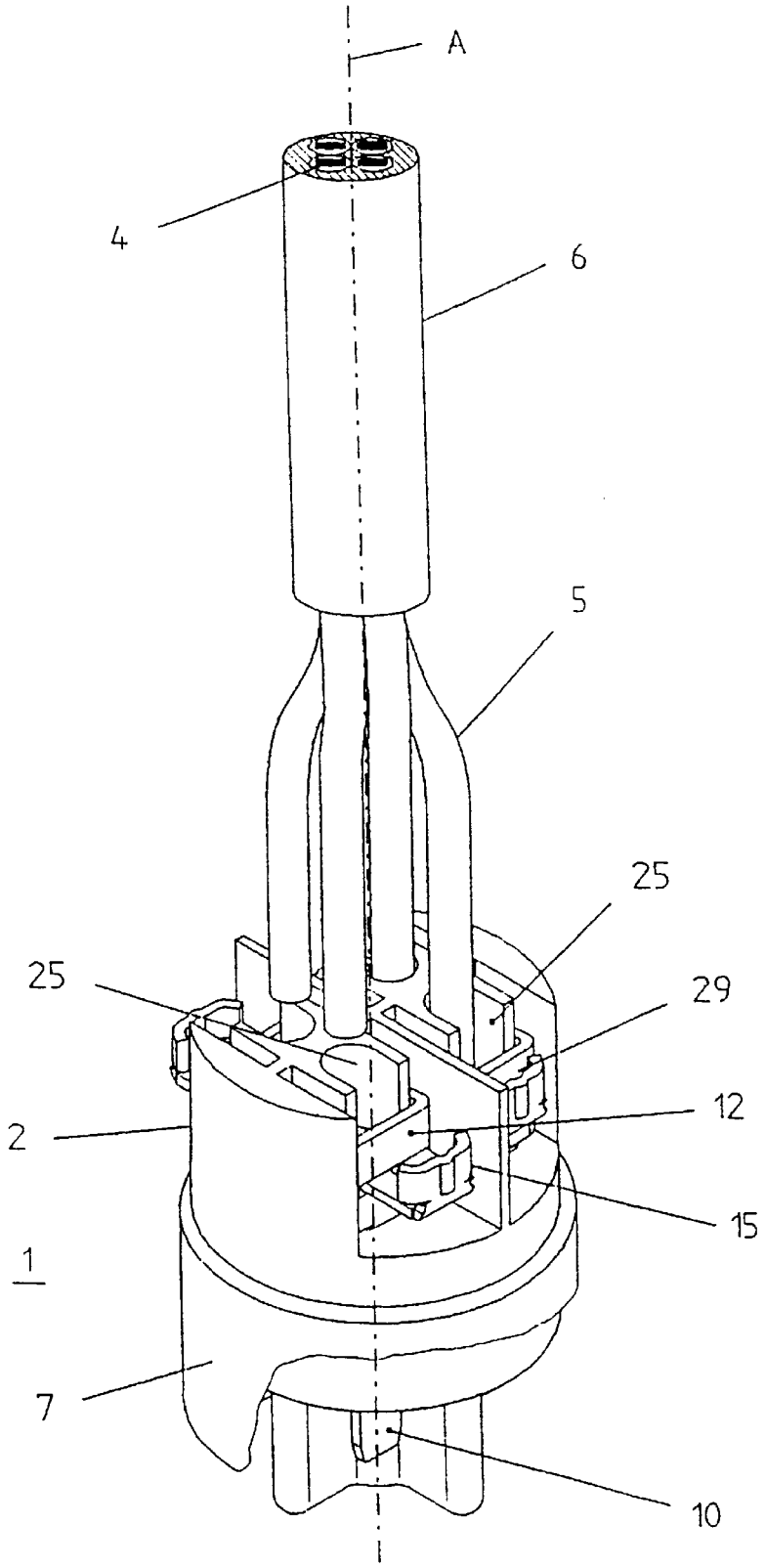
FIG. 1 shows a partially cutaway perspective view of the first cable connector with two cable cores not yet connected and two connected.
Figure 2:
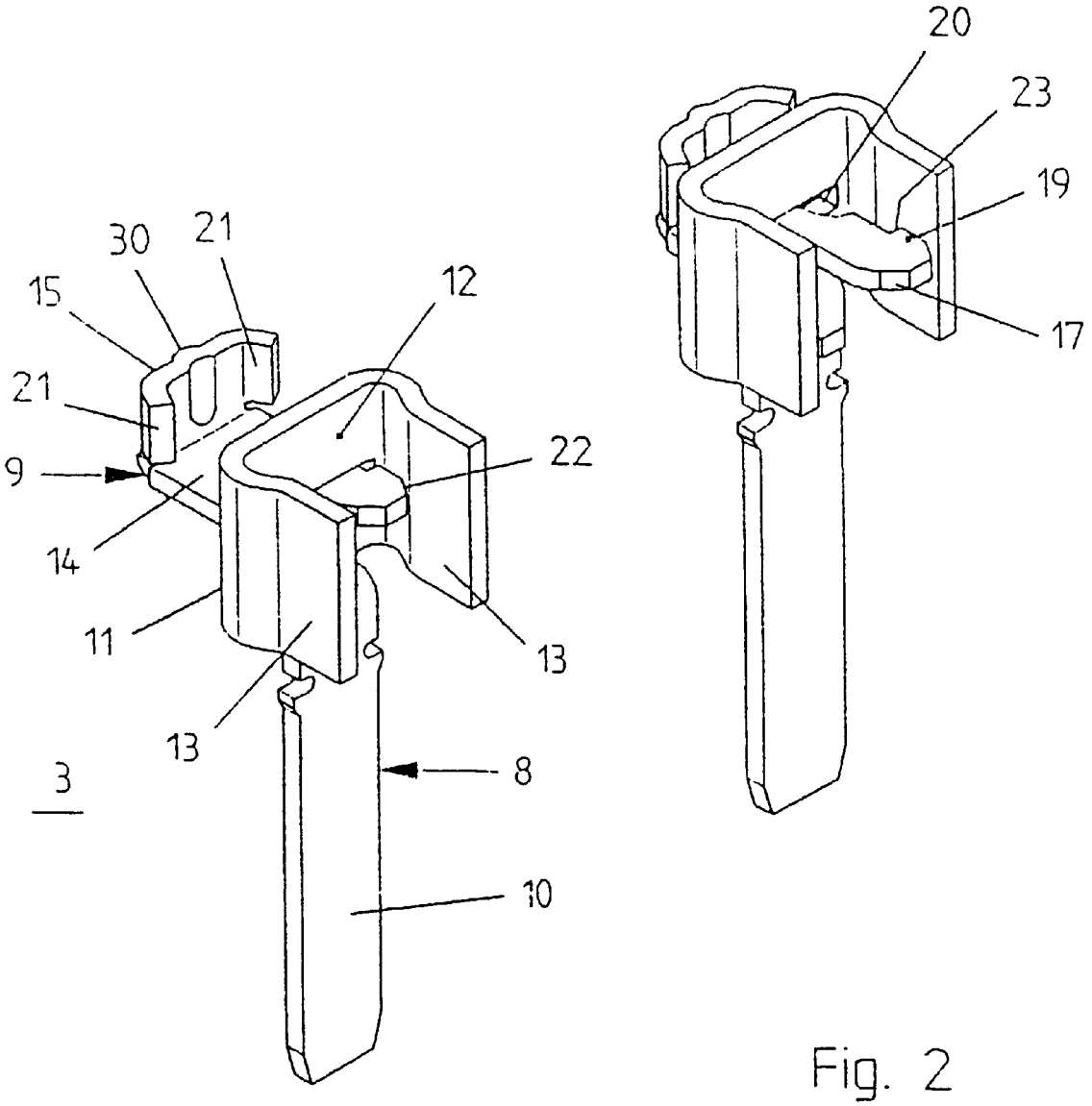
FIG. 2 shows one perspective view each of a contact with the contact plate inserted and the contact plate not inserted.
Figure 3:
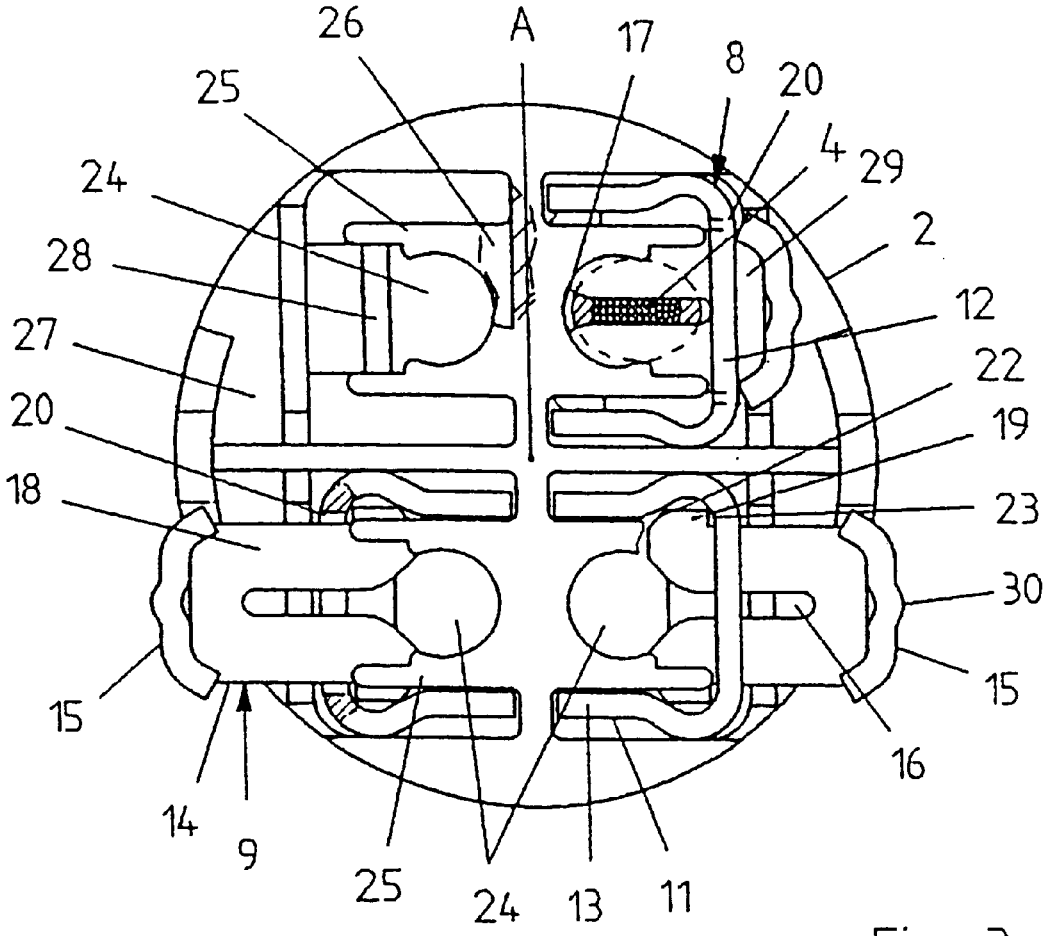
FIG. 3 shows a partially cutaway overhead view of the contact carrier with two insulation piercing connecting device terminals in the preliminary catch position, a connected cable core, and a connection site without the contact.
Figure 4:
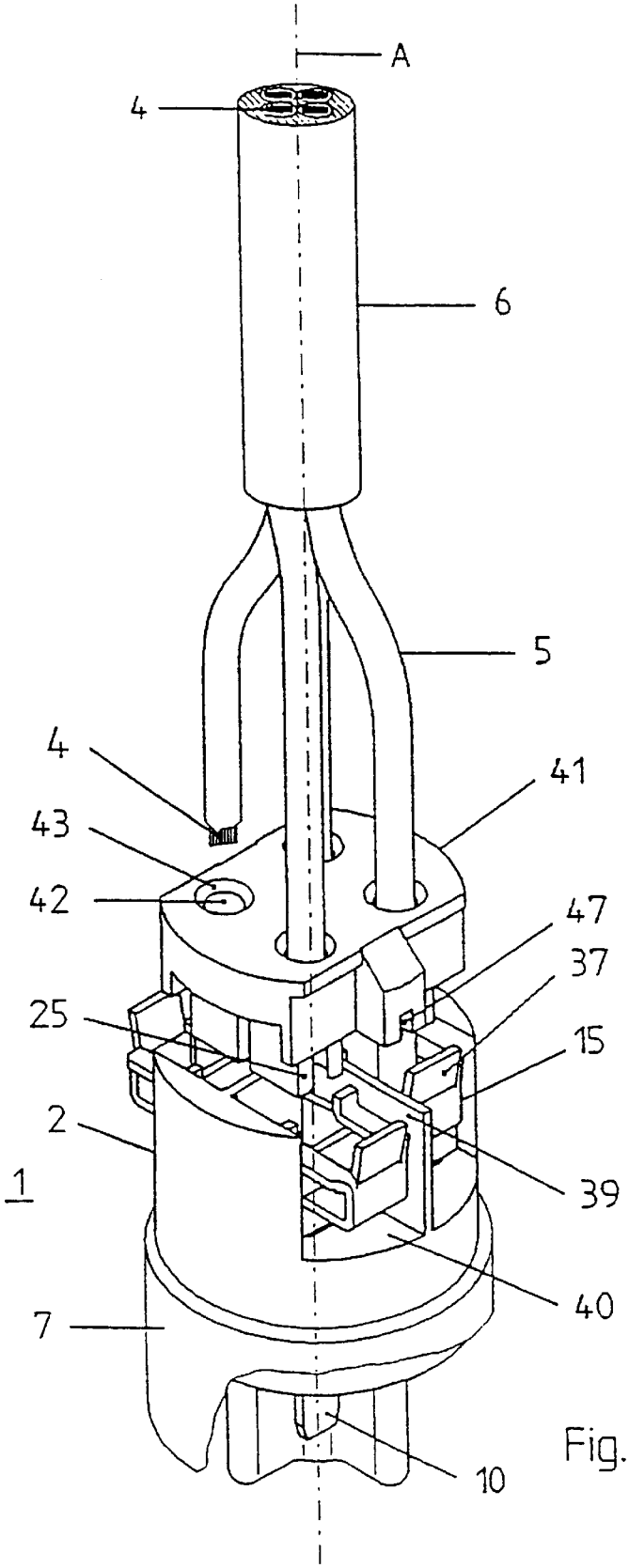
FIG. 4 shows a partially cutaway perspective view of the second cable connector with two cable cores connected and two not connected.
Figure 5:
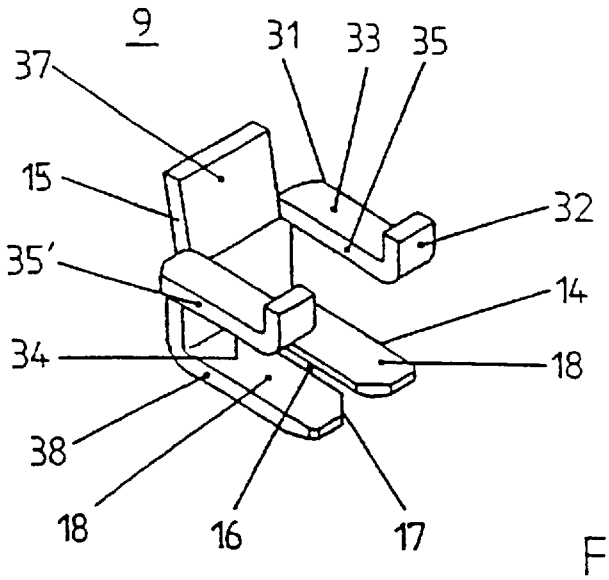
FIG. 5 shows a perspective view of the insulation-piercing connecting device part.
Figure 6:
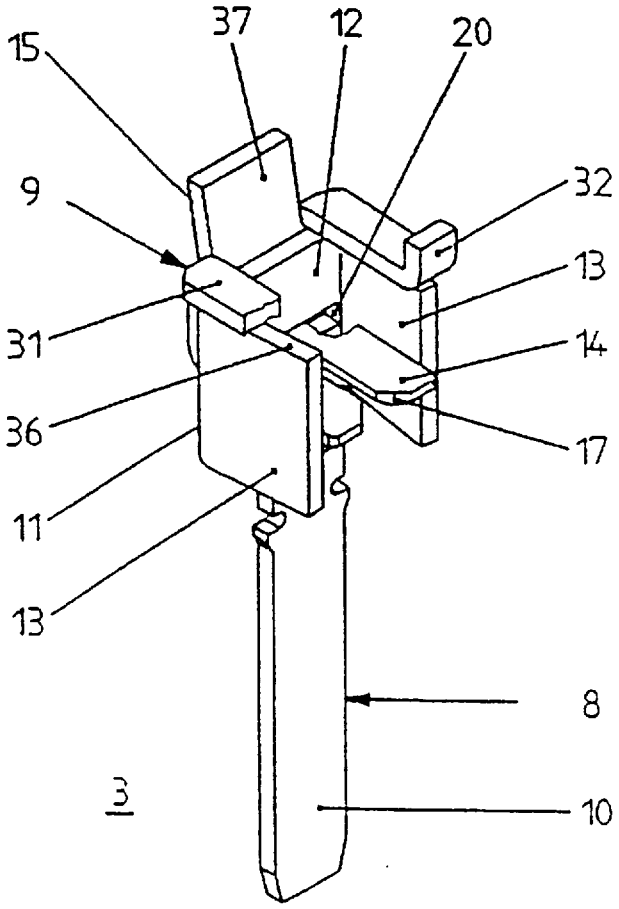
FIG. 6 shows a perspective view of a contact with partially inserted contact plate.
Figure 7:
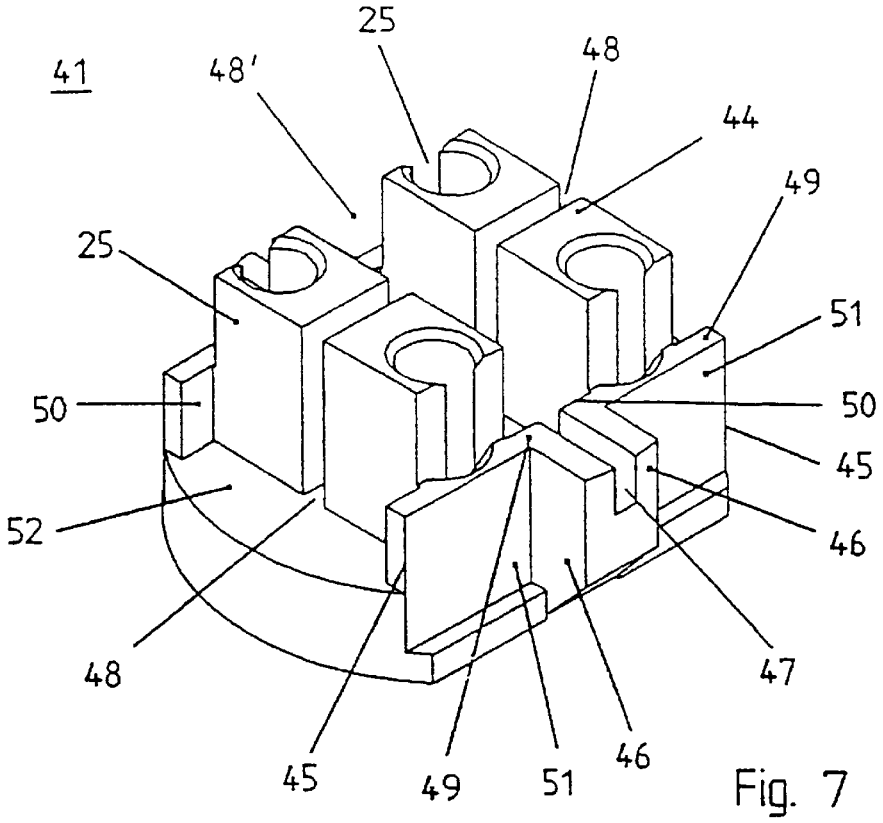
FIG. 7 shows a plug-side overhead view of the inside of the cover part and FIG. 8 shows a partially cutaway overhead view of the contact carrier with two detached insulation piercing connecting devices (preliminary catch position), a connected cable core and a connection site without the contact.
Figure 8:
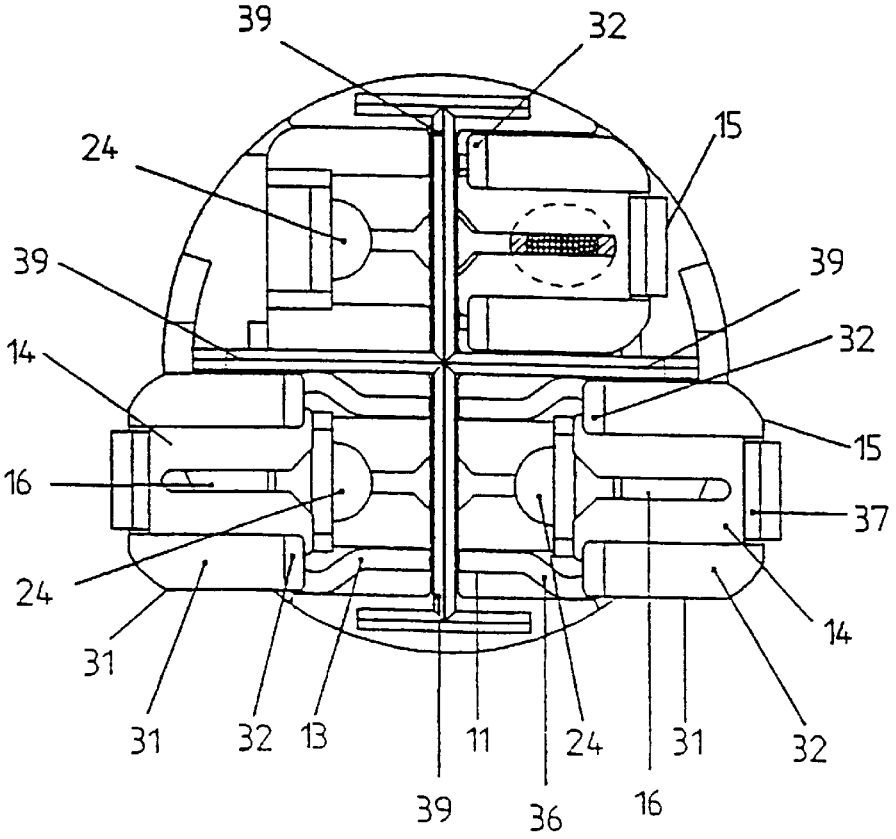

Cable connector 1 according to the first embodiment consists of plastic contact carrier 2, four contacts 3 located therein for electrical connection of stranded cores 4 of four insulated cable cores 5 of cable 6, and housing 7 which is made as a handle sleeve and which closely surrounds contact carrier 2 in the area of the cable terminal.

Contacts 3 each consist of plug-in contact part 8 and separate insulation piercing connecting device part 9. Each plug-in contact part 8 is made on the plug side as blade contact 10 for insertion into the matched sleeves of an opposite connector which is not shown and has roughly u-shaped terminal-side end part 11 with base wall 12 and two side walls 13.

Insulation-piercing connecting device part 9 consists of contact plate 14 and extension 15 which projects at a right angle from it. Contact plate 14 is made as an insulation piercing connecting device with insulation piercing connecting device slot 16 which has inlet bevel 17 for reliable insertion of cable cores 5. Clamping legs 18 formed by insulation-piercing connecting device slot 16 carry catch projections 19 which extend on the free end to the outside.

Base wall 12 includes slotted recess 20 which runs transversely to the plug-in direction and through which contact plate 14 can be inserted into the interior of terminal-side end part 11 until extension 15 with bent outside parts 21 adjoins the outside surface of base wall 12. The width of recess 20 corresponds roughly to that of contact plate 14 and is smaller than the mutual clearance of catch projections 19. The latter are provided on their front face with inlet bevel 22.

When contact plate 14 is inserted, it slides along the side edges of recess 20, in this way elastically pushing together the free end sections of clamping legs 18 to such an extent that contact plate 14 can be inserted through recess 20. Then clamping legs 18 snap apart so that catch projections 19 with catch shoulders 23 fit behind side edge sections of recess 20 and insulation piercing connecting device part 9 is located captively in the plug-in contact part, but, in contrast to the prior art with one-piece contacts, if necessary it can be detached by a simple tool (preliminary catch position).

If necessary, other contact plates 14 with differently dimensioned insulation-piercing connecting device slots 10 can be used due to this detachability.

Contact carrier 2 has four blind holes 24 which run in the axial direction of cable connector 1 for insertion of the free end sections of insulated cable cores 5 which continue on the terminal side in u-shaped guide parts 25 which are integral with contact carrier 2 and which are open towards insulation-piercing connecting device part 9; their shape and dimensions are matched to cable cores 5. At the height of recess 20 they each have slot 26 in which contact plate 14 can be inserted on the front side for neater guidance transversely to connector axis A. Guide parts 25 are arranged in pairs with a common base and open towards recesses 27 of contact carrier 2 through which insulation-piercing connecting device parts 9 can be inserted.

Furthermore, contact carrier 2 has four axial penetrations 28 for insertion of blade contacts 10. They are dimensioned such that their walls adjoin blade contacts 10 due to the elasticity of the plastic of contact carrier 2 under pressure and in this way yield a sealing effect. This is advantageous when, instead of housing 7 there is an extrusion coating, since unwanted penetration of extrusion coating material into the plug-in area is effectively prevented without additional cost.

In the finishing of the cable connector which can be easily done on site due to its simple structure, after stripping the end piece of cable 6, insulated individual cores 5 are completely inserted into blind holes 24. To make contact between cable cores 5 only two opposing insulation-piercing connecting device parts 9 need be pressed at the same time out of the preliminary catch position into slot 26 by means of a simple, pliers-shaped tool, the pliers arms engaging the outside surfaces of extensions 15. After completely inserting contact plate 14 (contact set position), outside parts 21 of extensions 15 adjoin pertinent base walls 12. Between them and extensions 15, intermediate space 29 remains which is dimensioned such that the corresponding tools can be inserted for detachment of insulation-piercing connecting device parts 9 if necessary.

So that the forces exerted by the arms of the pliers, both in insertion and removal of insulation-piercing connecting device parts 9 on extensions 15, can be reliably accommodated, the extensions are provided with raised area 30 for stiffening.

When contact plates 14 are pressed into cable cores 5, which are exactly positioned by blind holes 24 and guide parts 25 and which are fixed by adjoining the walls of blind holes 24 and guide parts 25 on the two sides of slots 26 for penetration into insulation-piercing connecting device slots 16, first on the edges of inlet bevels 17, the stranded insulation is cut through and then the stranded cores 4 are pressed into insulation piercing connecting device slots 16 such that as the stranded wires are deformed and partially compressed, permanently reliable contact of stranded cores 4 via contact plates 14 and side walls 13 of plug-in contact parts 8 which adjoin catch projections 19 under spring pressure with their blade contacts 10, is ensured even under unfavorable ambient conditions. In this case, as a result of the described structure short circuits by straying stranded wires are reliably prevented.

In the contact set position, extensions 15 are inserted into recesses 27 of contact carrier 2 to such an extent that their parts projecting farthest to the outside are flush with the outside contour of contact carrier 2. Thus, on the one hand the desired contact position of all insulation-piercing connecting device parts 9 is reliably safeguarded, and at the same time it is ensured that these positions have in fact also been assumed by insulation-piercing connecting device parts 9 when they are mounted, because otherwise the last mounting step, specifically the pushing of handle sleeve 7 onto contact carrier 2, cannot be done due to the projecting parts.

The cable connector according to the second embodiment consists of plastic contact carrier 2, four contacts 3 located therein for electrical connection of stranded cores 4 of four insulated cable cores 5 of cable 6, and housing 7 which is made as a handle sleeve and which closely surrounds contact carrier 2 in the area of the cable terminal.

Contacts 3 each consist of plug-in contact part 8 and separate insulation-piercing connecting device part 9. Each plug-in contact part 8 is made on the plug side as blade contact 10 for insertion into matched sleeves of the opposing connector (not shown) and has u-shaped, terminal-side end part 11 with base wall 12 and two side walls 13.

Insulation-piercing connecting device part 9 consists of contact plate 14 and extension 15 which projects at a right angle from it. Contact plate 14 is made as an insulation-piercing connecting device with insulation-piercing connecting device slot 10 which has inlet bevels 17 for reliable insertion of one cable core 5. However, clamping legs 18, formed by insulation-piercing connecting device slot 16, do not carry any catch projections.

Extension 15 has two guide arms 31 which are integral with it, which run parallel to clamping legs 18 and which are roughly of the same length with them. Free end pieces 32 are bent by 90 degrees in the terminal-side direction.

Guide arms 31 have terminal-side surface 33, plug-side surface 34 and inner and outer longitudinal edge 35, 35'. Plug-side surfaces 34 lie on terminal-side front surface 36 of terminal-side end part 11 of plug-in contact part 8. The area of extension 15 which lies between guide arms 31 is extended as link 37, which is bent to the outside at a small angle.

In base wall 12 of plug-in contact part 8, slotted recess 20 which runs transversely to the plug-in direction, is attached and through it contact plate 14 can be inserted into the interior of terminal-side end part 11 to such an extent that extension 15 adjoins the outside surface of base wall 12. The width of recess 20 is thus slightly larger than that of contact plate 14. When contact plate 14 is inserted its side edges 38 slide along the inside surfaces of side walls 13 of terminal-side end part 11 of plug-in contact part 8.

Contact carrier 2 has four contact chambers 40 which are separated from one another by separators 39 and in which contact of stranded cores 4 of cable cores 5 with contacts 3 is made by the insulation-piercing connecting device. They are open on the terminal side and laterally for activation of insulation-piercing connecting device parts 9.

In each contact chamber 40 there is axial blind hole 24 into which pertinent insulated cable core 5 can be inserted.

Furthermore, in this cable connector 1 there is plastic cover part 41 which, after insertion of contacts 3 into contact carrier 2, is permanently connected to the latter by plastic welding. Cover part 41 has four penetration openings 42, with insertion funnels 43 that continue as u-shaped guide parts 25, which project on the plug side and which have core receiving areas which are matched in shape and dimensions to cable cores 5.

When cover part 41 is attached, guide parts 25 which are flush with blind holes 24, dip so far into contact chambers 40 of contact carrier 2 that between their free faces 44 and the edge parts of blind holes 24 at the height of recess 20 of terminal-side end part 11 of plug-in contact part 8, a slot is formed for insertion of contact plate 14.

Cover part 41 furthermore has four L-shaped walls 45 with short legs 46 which include one axial groove-shaped recess 47. Guide parts 25 are separated from one another in pairs by gaps 48, 48' which run perpendicularly to recesses 47. These recesses 47 and gaps 48, 48' are arranged such that when cover part 41 and contact carrier 2 are joined, they hold the terminal-side end areas of separators 39 of contact chambers 40. In this way, correct assignment is ensured of the identically-made guide parts, which are arranged axially symmetrical, and contact chambers 40. Neat alignment of guide parts 25 and blind holes 24 is ensured at the same time, and exact preliminary fixing for the welding process is achieved.

When cover part 41 is attached, terminal-side surfaces 33 of guide arms 31 adjoin front surfaces 49 of L-shaped walls 45. Guide arms 31 are thus guided neatly in the axial direction between these front surfaces 49 and terminal-side front surfaces 36 of end part 11 of plug-in contact part 8, and skewing in recess 20 is reliably prevented.

In the transverse direction the same advantage is achieved by guidance of side edges 38 of clamping legs 18 of contact plate 14 on side walls 13 of terminal-side end part 11 of plug-in part 8, by guidance of inner longitudinal edges 35 of guide arms 31 on guide parts 25, and by guidance of outer longitudinal edges 35' of guide arms 31 on the inside surfaces of chamber separators 39.

Wall parts 50 of longer leg 51 of walls 45, that is, the parts which project laterally over guide parts 25, are used at the same time as the stop for withdrawn (opened) insulation-piercing connecting device parts 9 which in this way cannot be lost.

The second embodiment is characterized by an especially simple structure which can be economically produced by simple tools. In addition, insulation piercing connecting device part 9 need not be made elastic, but can consist of rigid material which ensures a defined clamping force.

Finally, assembly can be done quickly and reliably by the following mounting steps:

After insertion of contact plate 14 of insulation-piercing connecting device parts 9 through the recesses of the plug-in contact parts 8, contacts 3 with their blade contacts 10 are inserted through the openings of contact carrier 2 provided for this purpose. Then cover part 41 is seated on contact carrier 2 such that separators 39, arranged in a cross shape, fit into groove-shaped recesses 47 of L-shaped walls 45 and into gaps 48, 48' between guide parts 25 and inner cover surface 52, and lies on a corresponding terminal-side surface of contact carrier 2.

Cover part 41 and contact carrier 42 are welded at this time.

Then the cable is connected when contact carrier 2 is sealed with cover part 41 and is completely premounted. To do this, first insulation-piercing connecting device parts 9 must be removed from end part 11 of plug-in contact part 8 until end pieces 32 meet wall parts 50 of walls 45. A simple tool (for example, a screwdriver) is inserted between the terminal-side end of extension 15, made as link 37, which is bent somewhat to the outside, and then terminal-side end part 11 of plug-in contact part 8 is inserted and pressed to the outside.

Subsequently, four unstripped cable cores 5 are inserted into penetration openings 42 of cover part 41 and inserted into blind holes 24 by feeding entire cable 6 until it stops.

To make contact between stranded cores 4 and insulation-piercing connecting device parts 9, they can now be pressed merely in the contact chambers. This can be done using a simple, pliers-like tool.

Mounting of cable connector 1 is ultimately completed by inserting connected contact carrier 2 into housing 7.

What is claimed is:

1. A cable connector, comprising:

a plug-in contact part having a terminal-side end part with a recess, said plug-in contact part disposed in a chamber of a contact carrier;

an insulation-piercing connecting device part having (i) a contact plate with an insulation-piercing connecting device slot, said contact plate and said insulation-piercing connecting device slot oriented transversely to a plug-in direction of the plug-in contact part, and (ii) an extension angled at approximately 90 degrees to the contact plate and located on an outer side of the terminal-side end part opposite a cable terminal part;

wherein the insulation-piercing connecting device part is disposed in contact with an insulated cable core, said cable core spaced away from the plug-in contact part;

wherein the insulation-piercing connecting device part is a separate part from the plug-in contact part and is disposed with the contact plate in the recess oriented transversely to an axis of the cable core;

wherein said insulation-piercing connecting device part is further disposed in a blind hole of the contact carrier using said contact plate as a guide; and wherein the extension is shaped for adjoining an outside surface of the terminal-side end part when the cable core is disposed in contact with the extension.

2. A cable connector, comprising:

a plug-in contact part having a terminal-side end part with a recess, said plug-in contact part disposed in a chamber of a contact carrier;

an insulation-piercing connecting device part having a contact plate with an insulation-piercing connecting device slot, said contact plate and said insulation-piercing connecting device slot oriented transversely to a plug-in direction of the plug-in contact part;

wherein the insulation-piercing connecting device part is disposed in contact with an insulated cable core, said cable core spaced away from the plug-in contact part;

wherein the insulation-piercing connecting device part is a separate part from the plug-in contact part and is disposed with the contact plate in the recess oriented transversely to an axis of the cable core;

wherein said insulation-piercing connecting device part is further disposed in a blind hole of the contact carrier using said contact plate as a guide; and wherein the terminal-side end part includes a u-shape and two side walls in forcible contact with catch projections of the contact plate.

3. A cable connector, comprising:

a plug-in contact part having a terminal-side end part with a recess, said plug-in contact part disposed in a chamber of a contact carrier;

an insulation-piercing connecting device part having (i) a contact plate with an insulation-piercing connecting device slot, said contact plate and said insulation-piercing connecting device slot oriented transversely to a plug-in direction of the plug-in contact part, and (ii) an extension angled at approximately 90 degrees to the contact plate and located on an outer side of the terminal-side end part opposite a cable terminal part;

wherein the insulation-piercing connecting device part is disposed in contact with an insulated cable core, said cable core spaced away from the plug-in contact part;

wherein the insulation-piercing connecting device part is a separate part from the plug-in contact part and is disposed with the contact plate in the recess oriented transversely to an axis of the cable core;

wherein said insulation-piercing connecting device part is further disposed in a blind hole of the contact carrier using said contact plate as a guide; and wherein the insulation-piercing connecting device part includes two guide arms projecting from the extension in an insert direction and closely surrounding u-shaped insulation parts, said guide arms having terminal-side and plug-side surfaces for sliding along guide surfaces of the contact carrier during insertion or removal.

4. The cable connector of claim 3, wherein a collective width of the two guide arms is slightly less than a clearance of chamber separators, and wherein a clearance between the two guide arms is slightly larger than an outside dimension of the u-shaped insulation parts.

5. The cable connector of claim 3, wherein the guide arms are integral with the insulation-piercing connecting device part.

6. The cable connector of claim 3, wherein the guide arms include end pieces extending in a terminal-side direction and fitting behind a retaining shoulder when the insulation-piercing connecting device part is not in contact with the cable core.

7. The cable connector of claim 3, wherein a length of the guide arms corresponds to a greatest length of the contact plate.

8. The cable connector of claim 3, wherein the extension includes a link projecting between the guide arms in a generally axial direction of the cable connector and extending outwardly.

9. A comprising:

a plug-in contact part having a terminal-side end part with a recess, said plug-in contact part disposed in a chamber of a contact carrier;

an insulation-piercing connecting device part having (i) a contact plate with an insulation-piercing connecting device slot, said contact plate and said insulation-piercing connecting device slot oriented transversely to a plug-in direction of the plug-in contact part, and (ii) an extension having at least two contact slots and angled at approximately 90 degrees to the contact plate and located on an outer side of the terminal-side end part opposite a cable terminal part;

wherein the insulation-piercing connecting device part is disposed in contact with an insulated cable core, said cable core spaced away from the plug-in contact part;

wherein the insulation-piercing connecting device part is a separate part from the plug-in contact part and is disposed with the contact plate in the recess oriented transversely to an axis of the cable core;

wherein said insulation-piercing connecting device part is further disposed in a blind hole of the contact carrier using said contact plate as a guide;

wherein a cross section of the extension corresponds to a cross section of the contact plate in the area of the insulation piercing connecting device slot and said cross section of the extension has an extension contact slot; and wherein the plug-side surfaces facing the contact plate adjoin a terminal-side face of the plug-in contact part, and the terminal-side surfaces facing away from the contact plate adjoin a front surface of a wall of the cover part.

10. The cable connector of claim 9, wherein a mutual distance of outside edges of the two guide arms of each insulation-piercing connecting device part is slightly less than a clearance of contact chamber separators, and wherein a clearance of the two guide arms of each insulation-piercing connecting device part is slightly larger than an outside dimension of the u-shaped insulation parts.

11. The cable connector of claim 10, wherein the guide arms are integral with the insulation-piercing connecting device part.

12. The cable connector of claim 11, wherein retaining shoulders are defined by walls of the cover part.

13. The cable connector of claim 11, wherein the guide arms include end pieces projecting in a terminal-side direction and fitting behind a retaining shoulder when the guide arms do not contact the insulation-piercing connecting device part.

14. A cable connector, comprising:

a plug-in contact part having a terminal-side end part with a recess, said plug-in contact part disposed in a chamber of a contact carrier;

an insulation-piercing connecting device part having a contact plate with an insulation-piercing connecting device slot, said contact plate and said insulation-piercing connecting device slot oriented transversely to a plug-in direction of the plug-in contact part;

wherein the insulation-piercing connecting device part is disposed in contact with an insulated cable core, said cable core spaced away from the plug-in contact part;

wherein the insulation-piercing connecting device part is a separate part from the plug-in contact part and is disposed with the contact plate in the recess oriented transversely to an axis of the cable core; and wherein said insulation-piercing connecting device part is further disposed in a blind hole of the contact carrier using said contact plate as a guide.

15. The cable connector of claim 14, wherein the recess is matched to a cross-sectional contour of the contact plate.

16. The cable connector of claim 14, wherein the contact plate has at least two insulation-piercing connecting device slots.

17. The cable connector of claim 14, further comprising a housing closely encompassing the contact carrier, wherein a part of the insulation-piercing connecting device part extending farthest outwardly in a contact position adjoins an inside surface of the housing.

18. The cable connector of claim 14, wherein the recess has a support surface extending towards a plug interior.

19. The cable connector of claim 3, wherein the support surface includes an outwardly-formed portion of the terminal-side end part.

20. The cable connector of claim 14, wherein the contact plate includes two clamping legs forming an insulation-piercing connecting device slot and having catch projections pointed outwardly with a collective width greater than a width of the recess.

21. The cable connector of claim 20, wherein the catch projections have an inlet bevel.

22. The cable connector of claim 14, wherein the insulation-piercing connecting device part includes an extension angled at approximately 90 degrees to the contact plate and located on an outer side of the terminal-side end part opposite a cable terminal part.

23. The cable connector of claim 22, wherein the extension includes at least one raised area.

24. The cable connector of claim 22, wherein an end section of the contact plate located outside of the terminal-side end part of the contact has a contact plate recess.

25. The cable connector of claim 22, wherein a cross section of the extension corresponds to a cross section of the contact plate in the area of the insulation piercing connecting device slot and said cross section of the extension has an extension contact slot.

26. The cable connector of claim 25, wherein the extension has at least two contact slots.

27. The cable connector of claim 22, wherein said extension is pointed outwardly.

28. The cable connector of claim 27, wherein a plurality of extensions are arranged symmetrically to a middle axis of the connector and parts of the extensions extending farthest outwardly match an outside contour of the cable connector.

29. The cable connector of claim 14, wherein a u-shaped insulation part is above an insertion area of a blind hole, the u-shaped insulation part having an opening facing the contact plate and having a slot vertically matched to a contour of the insulation-piercing connecting device part.

30. The cable connector of claim 29, wherein the insulation part is integral with the contact carrier.

31. The cable connector of claim 29, wherein the insulation part is integral with a cover part having a core penetration opening at a first end, and having a projection for connectably plugging into a chamber of the contact carrier at a second end.

32. The cable connector of claim 31, wherein the cover part is non-detachably connected to the contact carrier.

33. The cable connector of claim 31, further comprising a plurality of insulation parts configured to hold a plurality of pairs of terminal-side end parts, wherein each pair includes two terminal-side end parts opposite one another and offset by about 180 degrees.

34. The cable connector of claim 33, wherein an outside contour of one of the insulation parts and the chamber matched thereto is different from the other insulation parts.

35. The cable connector of claim 31, wherein the cover part is detachably connected to the contact carrier.

36. The cable connector of claim 31, wherein the cover part includes at least one recess and the contact carrier includes at least one corresponding terminal-side projection, wherein the terminal side projection is adapted for fitting into the recess when the cable connector is assembled.

37. The cable connector of claim 36, wherein said terminal-side projection is insertable into said recess between the u-shaped insulation parts.

38. A comprising:

a plug-in contact part having a terminal-side end part with a recess, said plug-in contact part disposed in a chamber of a contact carrier;

an insulation-piercing connecting device part having a contact plate with an insulation-piercing connecting device slot, said contact plate and said insulation-piercing connecting device slot oriented transversely to a plug-in direction of the plug-in contact part;

wherein the insulation-piercing connecting device part is disposed in contact with an insulated cable core, said cable core spaced away from the plug-in contact part;

wherein the insulation-piercing connecting device part is a separate part from the plug-in contact part and is disposed with the contact plate in the recess oriented transversely to an axis of the cable core;

wherein said insulation-piercing connecting device part is further disposed in a blind hole of the contact carrier using said contact plate as a guide;

wherein a u-shaped insulation part is above an insertion area of a blind hole, the u-shaped insulation part having an opening facing the contact plate and having a slot vertically matched to a contour of the insulation-piercing connecting device part;

wherein the insulation part is integral with a cover part having a core penetration opening at a first end, and having a projection for connectably plugging into a chamber of the contact carrier at a second end; and wherein the insulation-piercing connecting device part includes two guide arms closely surrounding the u-shaped insulation parts on a side when the insulation-piercing connecting device part is disposed therein, the guide arms projecting from the extension in an insert direction and having terminal-side and plug-side surfaces for sliding along guide surfaces of the contact carrier and guide surfaces of the cover part during insertion or removal.

* * * * *